US005722873A

United States Patent [19]

Ishimoto

[11] Patent Number: 5,722,873

[45] Date of Patent: Mar. 3, 1998

[54] RADIO-CONTROLLED TOY CAR WITH AN IMPROVED STEERING SYSTEM

[75] Inventor: Zenichi Ishimoto, Tokyo, Japan

[73] Assignee: Nikko Co., Ltd., Tokyo, Japan

[21] Appl. No.: 671,483

[22] Filed: Jun. 27, 1996

[30] Foreign Application Priority Data

Jun. 28, 1995 [JP] Japan ..... 7-162309

[51] Int. Cl.[6] ..... A63H 30/04; A63H 29/00; A63H 17/36; A63H 29/24

[52] U.S. Cl. ..... 446/456; 446/457; 446/460; 446/463

[58] Field of Search ..... 446/456, 454, 446/455, 457, 460, 465, 468, 469, 444, 448, 437

[56] References Cited

U.S. PATENT DOCUMENTS

| | | | |
|---|---|---|---|
| 3,862,514 | 1/1975 | Ueda | 446/456 |
| 4,034,504 | 7/1977 | Sudo | 446/456 |
| 4,197,672 | 4/1980 | Mabuchi et al. | 446/456 |
| 4,213,270 | 7/1980 | Oda . | |

FOREIGN PATENT DOCUMENTS

| | | | |
|---|---|---|---|
| 22170 | 10/1961 | Germany | 446/454 |
| 2852635 | 6/1979 | Germany | 446/456 |
| 2903192 | 8/1979 | Germany | 446/454 |
| 1 498 775 | 1/1978 | United Kingdom . | |
| 1 581 243 | 12/1980 | United Kingdom . | |
| 1581243 | 12/1980 | United Kingdom | 446/456 |
| 2112655 | 9/1983 | United Kingdom | 446/456 |

*Primary Examiner*—D. Neal Muir

*Attorney, Agent, or Firm*—Young & Thompson

[57] ABSTRACT

The present invention provides a steering system provided on a chassis of a toy car comprising the following elements. A rotatable steering plate is rotatably provided on the chassis so as to rotate in a horizontal plane by a predetermined maximum angle toward left and right directions from a longitudinal center axis of the chassis. A spring member is provided on the chassis and mechanically connected to the rotatable steering plate at a position spaced apart from the longitudinal center axis of the chassis for forcing the rotatable steering plate to rotate and tilt toward one of the left and right directions from the longitudinal center axis of the chassis. A steering motor is provided on the chassis for generating a rotation power and the steering motor having a motor shaft. A rotary shaft is provided on the chassis. A transmission system mechanically connects the motor shaft and the rotary shaft for transmitting the rotation power generated by the steering motor into the rotary shaft. A first wheel is so mechanically connected to a first end of the rotary shaft that the first wheel is allowed to rotate freely from the rotary shaft. A second wheel is mechanically connected to a second end of the rotary shaft. The second wheel has a clutch mechanism so operating that if the steering motor is driven, then the rotation power is transmitted to the second wheel and thus the second wheel is driven whereby the rotatable steering plate is forced to direct in parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate and tilt toward the one of the left and right directions from the longitudinal center axis of the chassis.

10 Claims, 5 Drawing Sheets

RADIO-CONTROLLED TOY CAR WITH AN IMPROVED STEERING SYSTEM

BACKGROUND OF THE INVENTION

1. Field of the Invention

The present invention relates to a radio-controlled toy car, and more particularly to an improved steering system for a radio-controlled toy car.

2. Description of the Prior Art

In recent years, the steering system of the radio-controlled toy car has become complicated because of recent tendency to pursue various and complex motions such as a rapid turning motion to attract a user's attention. This tendency has also made a signal transmitter complicated so that the signal transmitter has, for example, a plurality of control levers and one or more push-switches for controlling the steering, the movement in forward and reverse directions, and the traveling speed.

Hence, complex internal mechanisms are required, including complicated steering systems on a chassis of the toy car or accommodated in a body thereof. This increases the manufacturing cost of the radio-controlled toy car and makes it difficult for children to operate the radio-controlled toy car.

As a result, applicant saw a need for a simple, inexpensive radio-controlled toy car, the cost of which reflects a reduction in manufacturing cost thereof, and that is easily operable by children for amusing themselves and attracting them.

SUMMARY OF THE INVENTION

Accordingly, it is an object of the present invention to provide a simple radio-controlled toy car set at an inexpensive price by reduction in manufacturing cost thereof.

It is a further object of the present invention to provide a simple radio-controlled toy car that is easily operable by children for amusing themselves and attracting them.

The above and other objects, features and advantages of the present invention will be apparent from the following descriptions.

The present invention provides a steering system provided on a chassis of a toy car comprising the following elements. A rotatable steering plate on the chassis rotates in a horizontal plane by a predetermined maximum angle toward the left and right directions from a longitudinal center axis of the chassis. A spring member on the chassis is mechanically connected to the rotatable steering plate at a position spaced away from the longitudinal center axis of the chassis for forcing the rotatable steering plate to rotate toward the left or the right direction from the longitudinal center axis of the chassis. A steering motor on the chassis generates a rotation power, the steering motor having a motor shaft. A rotary shaft is provided on the chassis. A transmission system mechanically connects the motor shaft and the rotary shaft for transmitting the rotation power generated by the steering motor to the rotary shaft. A first wheel is mechanically connected to a first end of the rotary shaft so that the first wheel is allowed to rotate freely from the rotary shaft. A second wheel is mechanically connected to a second end of the rotary shaft. The second wheel has a clutch mechanism operating such that if the steering motor is driven, then the rotation power is transmitted to the second wheel to drive the second wheel, whereby the rotatable steering plate is forced to align itself parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate toward the left or the right direction from the longitudinal center axis of the chassis.

The present invention also provides a radio-controlled toy car comprising as follows. The toy car has a chassis on which is provided a body. A driving motor is provided for driving a driving shaft which connects a pair of driving wheels for directing the radio-controlled toy car. A rotatable steering plate on the chassis rotates in a horizontal plane by a predetermined maximum angle toward the left and right directions from a longitudinal center axis of the chassis. A spring member on the chassis is mechanically connected to the rotatable steering plate at a position spaced away from the longitudinal center axis of the chassis for forcing the rotatable steering plate to rotate toward the left or the right direction from the longitudinal center axis of the chassis. A steering motor on the chassis generates a rotation power, the steering motor having a motor shaft. A control unit on the chassis controls the steering motor. A rotary shaft is provided on the chassis. A transmission system mechanically connects the motor shaft and the rotary shaft for transmitting the rotation power generated by the steering motor to the rotary shaft. A first wheel is mechanically connected to a first end of the rotary shaft so that the first wheel is allowed to rotate freely from the rotary shaft. A second wheel is mechanically connected to a second end of the rotary shaft. The second wheel has a clutch mechanism, wherein if the steering motor is driven, then the rotation power is transmitted to the second wheel. Thus, the second wheel is driven, whereby the rotatable steering plate is forced to align itself parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate toward the left or the right direction from the longitudinal center axis of the chassis.

BRIEF DESCRIPTION OF THE DRAWINGS

Preferred embodiments according to the present invention will be described in detail with reference to the accompanying drawings.

DISCLOSURE OF THE INVENTION

Figure 1:
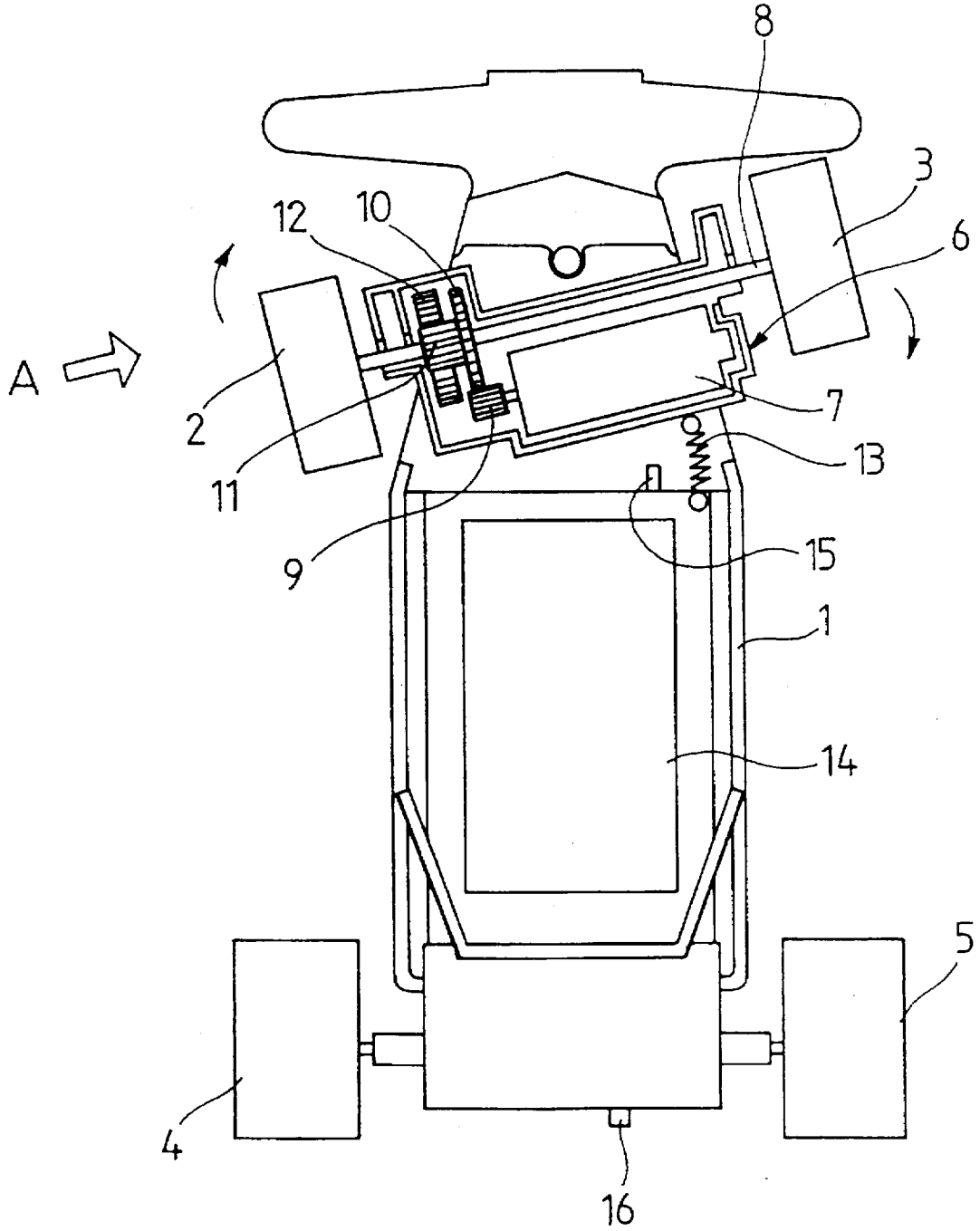
FIG. 1 is a plane view of a whole internal mechanism including an improved steering system of a preferred embodiment according to the present invention.

The present invention provides a steering system provided on a chassis of a toy car comprising the following elements.

A rotatable steering plate is rotatably provided on the chassis so as to rotate in a horizontal plane by a predetermined maximum angle toward left and right directions from a longitudinal center axis of the chassis. A spring member on the chassis is mechanically connected to the rotatable steering plate at a position spaced away from the longitudinal center axis of the chassis for forcing the rotatable steering plate to rotate toward the left or the right direction from the longitudinal center axis of the chassis. A steering motor on the chassis generates a rotation power, the steering motor having a motor shaft. A rotary shaft is provided on the chassis. A transmission system mechanically connects the motor shaft and the rotary shaft for transmitting the rotation power generated by the steering motor to the rotary shaft. A first wheel is mechanically connected to a first end of the rotary shaft so that the first wheel is allowed to rotate freely from the rotary shaft. A second wheel is mechanically connected to a second end of the rotary shaft. The second wheel has a clutch mechanism, wherein if the steering motor is driven, then the rotation power is transmitted to the second wheel. Thus, the second wheel is driven, whereby the rotatable steering plate is forced to align itself parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate toward the left or the right direction from the longitudinal center axis of the chassis.

It is possible for the spring member to provide an extension force to push a rear side portion of the rotatable steering plate in a front direction.

Alternatively, it is also possible for the spring member to provide a contraction force to pull a rear side portion of the rotatable steering plate in a rear direction.

It is preferable that the transmission system comprise a plurality of gears.

Advantageously, the clutch mechanism of the second wheel comprises the following. A disk-like plate is mechanically connected to the rotary shaft so that the disk-like plate rotates freely from the rotation of the rotary shaft. The disk-like plate has an outside surface on which an annular ridge is coaxially fixed. A center portion of the disk-like plate has an opening through which the rotary shaft penetrates so that the disk-like plate can rotate freely from the rotary shaft. A holding member is mechanically fixed to the second end of the rotary shaft. Positioned on an outside face of the disk-like plate, the holding member holds the disk-like plate to the rotary shaft, but allows the disk-like plate to rotate freely from the rotary shaft. The holding member has an elliptically cylindrical shape and extends outwardly. A cylindrically shaped, convex portion is provided on the holding member. The cylindrically shaped, convex portion is coaxially positioned on the holding member so that the convex portion extends from the holding member outwardly. The convex portion has a smaller diameter than not only a major axis, but also a minor axis of the holding member. A cam is elliptically, cylindrically shaped and has two recessed portions to form stepped portions at opposite ends on a major axis of the cam. The stepped portions face a direction opposite to the rotational direction of the second wheel, namely, the counterclockwise direction. The cam has an elliptically shaped opening at its center portion. The opening has a major axis tilted by less than 45° from the major axis of the cam in the direction opposite to the rotation direction of the second wheel. The major axis of the opening is sufficiently longer than the major axis of the holding member and a minor axis of the opening is just larger than the minor axis of the holding member so that the opening receives the holding member to form a gap between the opening and the holding member. A cylindrically shaped annular wheel member is inwardly open, while outwardly closed by a disk-like plate member with a hole at its center portion so that the hole receives the convex portion. A ridged portion extends along a radial, inner surface of the cylindrically shaped annular wheel member and toward a radial, inside direction. The ridged portion has a stepped face which may just fit into any of the stepped portions and the height of the ridged portion is gradually reduced to zero in the rotational direction of the second wheel.

The present invention also provides a radio-controlled toy car comprising as follows. A chassis is provided, a body provided on the chassis. A driving motor is provided for driving a driving shaft which connects a pair of driving wheels for propelling the radio-controlled toy car. A rotatable steering plate on the chassis rotates in a horizontal plane by a predetermined maximum angle toward the left and right directions from a longitudinal center axis of the chassis. A spring member on the chassis is mechanically connected to the rotatable steering plate at a position spaced away from the longitudinal center axis of the chassis for forcing the rotatable steering plate to rotate and tilt toward the left or the right direction from the longitudinal center axis of the chassis. A steering motor on the chassis generates a rotation power and the steering motor having a motor shaft. A control unit on the chassis controls the steering motor. A rotary shaft is provided on the chassis. A transmission system mechanically connects the motor shaft and the rotary shaft for transmitting the rotation power generated by the steering motor to the rotary shaft. A first wheel is mechanically connected to a first end of the rotary shaft so that the first wheel is allowed to rotate freely from the rotary shaft. A second wheel is mechanically connected to a second end of the rotary shaft. The second wheel has a clutch mechanism, wherein if the steering motor is driven, then the rotation power is transmitted to the second wheel. Thus, the second wheel is driven whereby the rotatable steering plate is forced to align itself parallel to the longitudinal center axis of the chassis. If, however, the steering motor is not driven, then the rotation power generated by the steering motor is not transmitted to the second wheel and thus the second wheel is not driven and does not rotate or rotates by inertia freely from the rotary shaft, whereby the rotatable steering plate is forced to rotate toward the one of the left and right directions from the longitudinal center axis of the chassis.

It is possible for the spring member to provide an extension force to push a rear side portion of the rotatable steering plate in a front direction.

Alternatively, it is also possible for the spring member to provide a contraction force to pull a rear side portion of the rotatable steering plate in a rear direction.

It is preferable that the transmission system is a transmission gear system comprising a plurality of gears.

Advantageously, the clutch mechanism of the second wheel comprises the following. A disk-like plate is mechanically connected to the rotary shaft so that the disk-like plate rotates freely from the rotation of the rotary shaft. The disk-like plate has an outside surface on which an annular ring ridge is coaxially fixed. A center portion of the disk-like plate has an opening through which the rotary shaft penetrates so that the disk-like plate can rotate freely from the rotary shaft. A holding member is mechanically fixed to the second end of the rotary shaft. Positioned on an outside face of the disk-like plate, the holding member holds the disk-like plate to the rotary shaft, but allows the disk-like plate to rotate freely from the rotary shaft. The holding member has an elliptically cylindrical shape and extends outwardly. A cylindrically shaped convex portion is provided on the holding member. The cylindrically shaped convex portion is coaxially positioned on the holding member so that the convex portion extends from the holding member outwardly. The convex portion has a smaller diameter than not only a major axis, but also a minor axis of the holding member. A cam is elliptically, cylindrically shaped and has two recessed portions to form stepped portions at opposite ends on a major axis of the cam. The stepped portions face a direction opposite to the rotational direction of the second wheel, namely, the counterclockwise direction. The cam has an elliptically shaped opening at its center portion. The opening has a major axis tilted by less than 45° from the major axis of the cam in the direction opposite to the rotation direction of the second wheel. The major axis of the opening is sufficiently longer than the major axis of the holding member and a minor axis of the opening is just larger than the minor axis of the holding member so that the opening receives the holding member to form a gap between the opening and the holding member. A cylindrically shaped annular wheel member is inwardly open while outwardly closed by a disk-like plate member with a hole at its center portion so that the hole receives the convex portion. A ridged portion extends along a radial inner surface of the cylindrically shaped annular wheel member and toward a radial inside direction. The ridged portion has a stepped face which may just fit into any of the stepped portions and the height of the ridged portion is gradually reduced to zero in the rotational direction of the second wheel.

PREFERRED EMBODIMENT

A preferred embodiment according to the present invention will be described in detail with reference to the accompanying drawings, wherein an improved steering system is provided for a novel radio-controlled toy car.

With reference to FIG. 1, a whole internal mechanism including an improved steering system of the radio-controlled toy car will be described. The radio-controlled toy car has a chassis 1 on which a control unit 14 is provided for controlling movement in forward and reverse directions and speed thereof. The rear end of the chassis 1 is provided with a driving motor container for containing a driving motor which has a rotary shaft connecting left and right rear wheels 4 and 5. At the rear side of the driving motor container is a power switch 16. On the chassis 1, a steering system is further provided in front of the control unit 14. The steering system is spaced apart from the control unit 14. The steering system has a rotatable steering plate 6 which is rotatably placed on the chassis 1 so that the rotatable steering plate 6 rotates in a horizontal plane by a predetermined maximum angle toward left and right directions from a longitudinal center axis of the chassis 1. A right, rear portion of the rotatable steering plate 6 is mechanically connected with one end of a spring member 13 which extends toward the rear and has an opposite end mechanically fixed to the chassis 1 in front of the front end of the control unit 14. The spring member 13 provides an extension force to push a right half of the rotatable steering plate 6 towards the front so that the rotatable steering plate 6 is forced to rotate in accordance with the extension force of the spring member 13. The rotatable steering plate 6 thereby is rotated by the predetermined maximum angle toward the right direction from the longitudinal center axis of the chassis 1.

On the rotatable steering plate 6, a steering motor 7 is provided, which has a motor shaft extending from the left side of the steering motor 7. The steering motor 7 is placed under the control by the control unit 14. The motor shaft is mechanically connected to a first steering gear 9, which rotates along with the motor shaft in the same direction. A second steering gear 10 engages the first steering gear 9 so that the second steering gear 10 rotates in a direction opposite to the rotary direction of the first steering gear 9. The second steering gear 10 is positioned in front of the first steering gear 9. The second steering gear 10 has a diameter much larger than the first steering gear 9, and thus, the number of gear teeth of the second steering gear 10 is much larger than the first steering gear 9. A third steering gear 11 is coaxially and unitarily fixed to the second steering gear 10 so that the third steering gear 11 rotates along with the second steering gear 10 in the same direction. The third steering gear 11 has a diameter smaller than the second steering gear 10, and thus, the number of gear teeth of the third steering gear 11 is smaller than the second steering gear 10. A fourth steering gear 12 engages the third steering gear 11 so that the fourth steering gear 12 rotates in a direction opposite to the rotary direction of the third steering gear 11. The fourth steering gear 12 is positioned below the third steering gear 11. The fourth steering gear 12 has a diameter much larger than the third steering gear 11, and thus, the number of gear teeth of the fourth steering gear 12 is much larger than the third steering gear 11. The above first to fourth steering gears 9, 10, 11 and 12 are provided on a left part of the rotatable steering plate 6. The fourth steering gear 12 is mechanically fixed to a rotary shaft, which connects the left and right front wheels 2 and 3. The left front wheel 2 thereby rotates along with the rotary shaft 8, while the right front wheel 3 rotates freely from the rotary shaft 8. This means that the rotational power is transmitted only to the left front wheel 2, but not transmitted to the right front wheel 3. The rotational power of the steering motor 7 is then transmitted via a transmission gear system comprising the first to fourth steering gears 9, 10, 11 and 12 to the rotary shaft 8 and further transmitted only to the left front wheel 2. The right front wheel 3 is free from the transmission of the rotation power of the steering motor 7. The rotary shaft 8 is also provided on the rotatable steering plate 6. When the rotatable steering plate 6 rotates in the horizontal plane within the predetermined maximum angle toward the left and right directions from the longitudinal center axis of the chassis 1, then the rotary shaft 8 and the left and right front wheels 2 and 3 also rotate along with the rotatable steering plate 6 whereby the left and right front wheels 2 and 3 change their direction along with the rotatable steering plate 6.

Further, a stopper convex portion 15 is provided on the chassis 1. The stopper convex portion 15 is positioned at the right side of the longitudinal center axis of the chassis 1, behind the rear end of the rotatable steering plate 6, but in front of the front end of the control unit 14. The stopper convex portion 15 is positioned closer to the longitudinal center axis of the chassis 1 than the spring member 13. The stopper convex portion 15 must be positioned so that the rear end of the rotatable steering plate 6 abuts the stopper convex portion 15 when the rotatable steering plate 6 is forced to rotate against the extension force of the spring member 13 so that the rotatable steering plate 6 is tilted by the predetermined maximum angle toward the right direction from the longitudinal center axis of the chassis 1.

Figure 2:
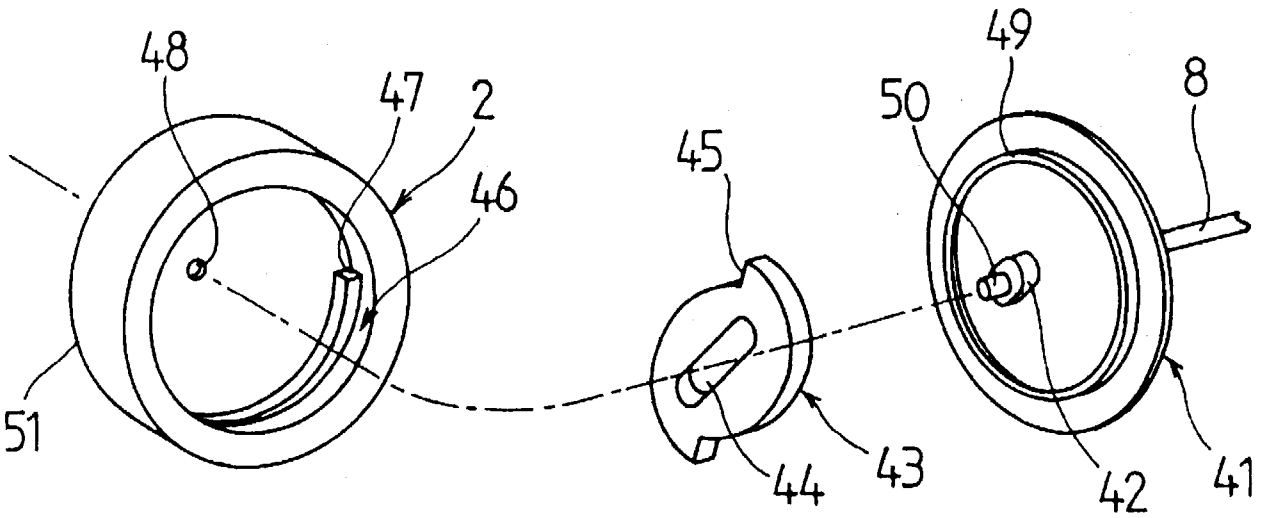
FIG. 2 is a view of disassembled left-front wheel parts included in an improved steering system of a preferred embodiment according to the present invention.

FIG. 2 is illustrative of disassembled left, front wheel parts. The left, front wheel 2 has a disk-like plate 41 mechanically connected to the rotary shaft 8 so that the disk-like plate 41 rotates freely from the rotation of the rotary shaft 8. The disk-like plate 41 has an outside surface on which an annular ridge 49 is coaxially fixed. The diameter of the annular ridge 49 is smaller than the disk-like plate 41 so that a peripheral portion of the disk-like plate 41 is positioned radially outside the annular ridge 49. The disk-like plate 41 has an opening at its center through which the rotary shaft 8 passes so that the disk-like plate 41 can rotate freely from the rotation of the rotary shaft 8. The left end of the rotary shaft 8 is mechanically fixed with a holding member 42, which is positioned on an outside face of the disk-like plate 41 so that the holding member 42 holds the disk-like plate 41 to the rotary shaft 8, but allows the disk-like plate 41 to rotate freely from the rotation of the rotary shaft 8. The holding member 42 has an elliptically cylindrical shape and extends toward the left side or the outside. Since the elliptically, cylindrically shaped holding member 42 is fixed with the left end of the rotary shaft 8, the holding member 42 is positioned at the center of the disk-like plate 41. The holding member 42 is provided with a cylindrically shaped convex portion 50 which is coaxially positioned on the elliptically, cylindrically shaped holding member 42 so that the cylindrically shaped convex portion 50 extends from the elliptically, cylindrically shaped holding member 42 toward the outside direction or the left direction. The cylindrically shaped convex portion 50 has a smaller diameter than not only a major axis, but also a minor axis of the elliptically, cylindrically shaped holding member 42. The left, front wheel 2 further has a cam 43 which is elliptically, cylindrically shaped and has two recessed portions to form stepped portions 45 at opposite ends on a major axis of the elliptically-shaped cam 43. In the left-side view, the stepped portions 45 of the elliptically shaped cam 43 face each other in a counterclockwise direction. The elliptically shaped cam 43 also has an elliptically shaped opening 44 at its center portion, wherein the elliptically shaped opening 44 has a major axis tilted by a small angle from the major axis of the elliptically shaped cam 43 toward the clockwise direction in the left side view. The elliptically shaped opening 44 of the elliptically shaped cam 43 has a major axis sufficiently longer than the major axis of the elliptically, cylindrically shaped holding member 42 and a minor axis just larger than the minor axis of the elliptically, cylindrically shaped holding member 42 so that the elliptically shaped opening 44 receives the elliptically, cylindrically shaped holding member 42 to form a gap between the elliptically shaped opening 44 and the elliptically, cylindrically shaped holding member 42. The gap is created by the difference in length of major axis between the elliptically, cylindrically shaped holding member 42 and the elliptically shaped opening 44. On the minor axis, the elliptically, cylindrically shaped holding member 42 fits into the elliptically shaped opening 44 of the elliptically shaped cam 43. The left, front wheel 2 furthermore has a cylindrically shaped annular wheel member 46. An inside or right side circular edge of the cylindrically shaped annular wheel member 46 is opened, while an outside or left side circular edge of cylindrically shaped annular wheel member 46 is closed by a disk-like plate member which has a hole 48 at its center portion so that the hole 48 receives the cylindrically shaped convex portion 50. The cylindrical shaped annular wheel member 46 has a radial outer surface on which a tire 51 is provided and further a radial inner surface to define an inner space which accommodates the elliptically shaped cam 43 and the annular ring ridge 49. The annular ring ridge 49, however, fits to the radial inner surface of the cylindrically shaped annular wheel member 46. A ridge portion 47 is provided extending along a half part of the radial inner surface of the cylindrically shaped annular wheel member 46. The ridged portion 47 varies in height in the radial inside direction so that the ridged portion 47 has a stepped face which just fits into the stepped portions 45. The height of the ridged portion 47 in the radial direction is gradually reduced to zero from almost the same height as the stepped portion 45 of the elliptically shaped cam 43 in the counterclockwise direction in the left side view. The elliptically shaped cam 43 is rotatably received in the inner space of the cylindrically shaped annular wheel member 46 so that the elliptically shaped cam 43 is in contact with the ridged portion 47. The stepped face of the ridged portion 47 may face the stepped portions 45 of the elliptically shaped cam 43.

Figure 3:
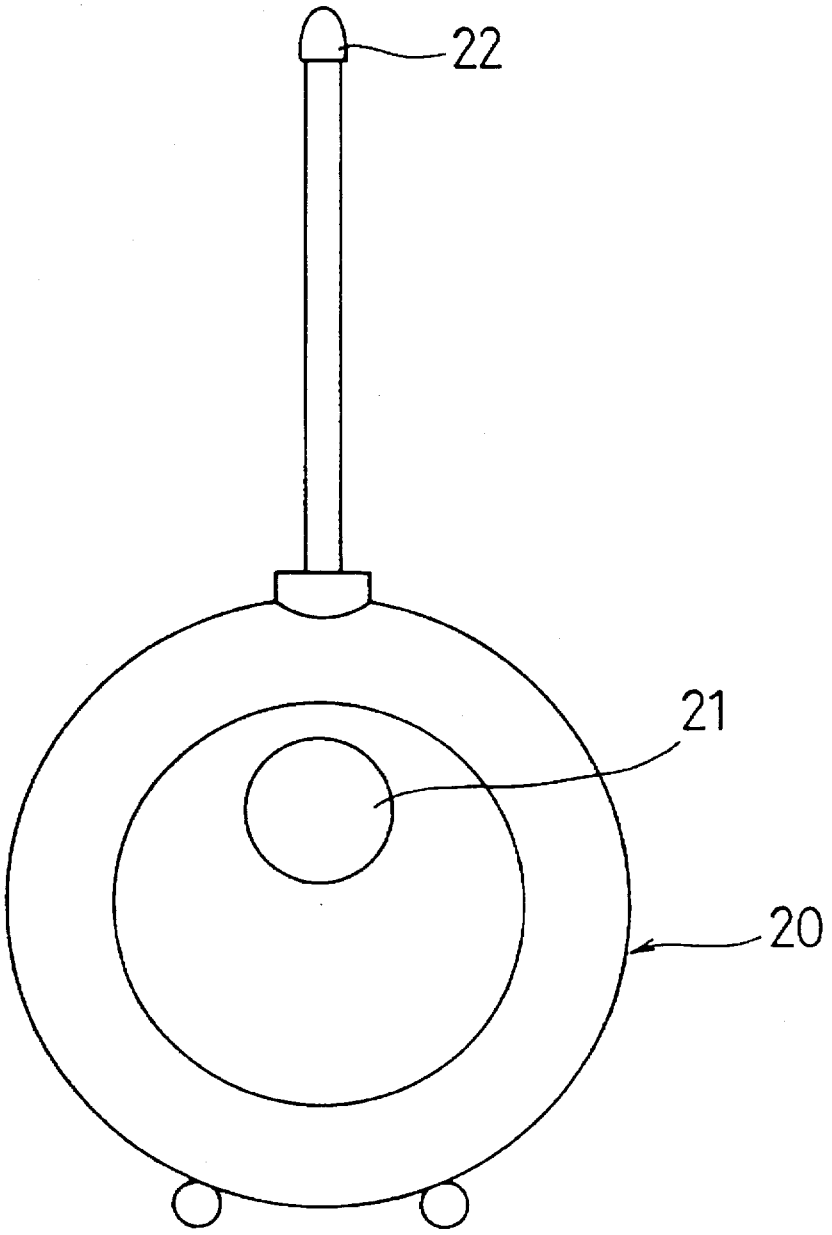
FIG. 3 is a front view of a control signal transmitter which transmits radio-control signals for controlling an improved steering system in a preferred embodiment according to the present invention.

FIG. 3 is illustrative of a control signal transmitter which transmits radio-control signals to a novel radio-controlled toy car for controlling an improved steering system thereof. The control signal transmitter comprises a body of a circular shape with a motor driving push button 21 and an antenna 22. If the motor driving push button 21 is pushed, then a motor driving signal is transmitted from the antenna 22 to the radio-controlled toy car.

Figure 4:
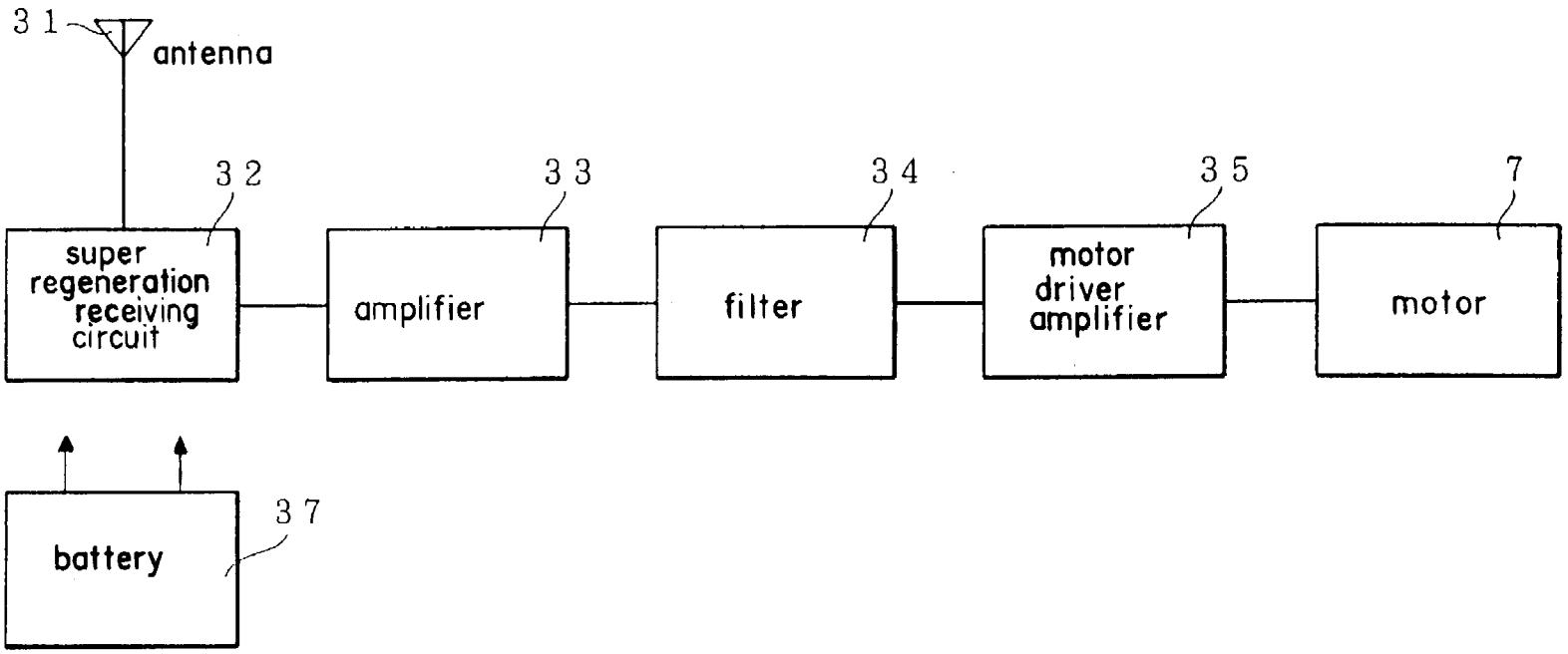
FIG. 4 is a block diagram of configurations of a control unit loaded on a chassis of a preferred embodiment according to the present invention.

FIG. 4 is illustrative of configurations of the control unit 14 provided on the chassis 1. The control unit 14 is supplied with power by a battery 37. The control unit 14 has an antenna 31 for receiving the radio-control signal having been transmitted from the control signal transmitter illustrated in FIG. 3. The control unit 14 also has a super-regeneration receiver circuit 32 connected to the antenna 31 for receiving the control signal transmitted via the antenna 31. An amplifier 33 is electrically connected to the super-regeneration received circuit 32 for fetching the control signal from the super-regeneration received circuit 32 and amplifying the fetched control signal. A filter 34 is electrically connected to the amplifier 33 for fetching the amplified control signal from the amplifier 33 and filtering the same. A motor driving amplifier 35 is electrically connected to the filter 34 and also connected to the steering motor 7 for fetching the filtered control signal from the filter 34 and controlling the driving of the steering motor 7.

The following description will focus on the operation of the steering system. The power switch 16 is pushed to turn ON. Then, motor driving push button 21 is pushed to transmit the motor driving control signal to the control unit 14. The motor driving control signal is received by the antenna 31 and then transmitted through the super-regeneration receiving circuit to the amplifier 33 so that the motor driving control signal is amplified. The amplified motor driving control signal is then transmitted to the filter 34 so that the amplified motor driving control signal is filtered. The filtered motor driving control signal is then transmitted to the motor driving amplifier 35 so that the steering motor 7 provided in the steering system is driven under the control of the motor driving amplifier 35. When the steering motor 7 is driven, then the rotation power of the steering motor 7 is transmitted through the transmission gear system comprising the first to fourth steering gears 9, 10, 11 and 12 into the rotary shaft 8. As described above, the left front wheel 2 is so connected to the rotary shaft 8 that the left front wheel 2 rotates along with the rotary shaft 8, while the right front wheel 3 is so connected to the rotary shaft 8 that the right front wheel 3 rotates freely from the rotary shaft 8.

Figure 5A:
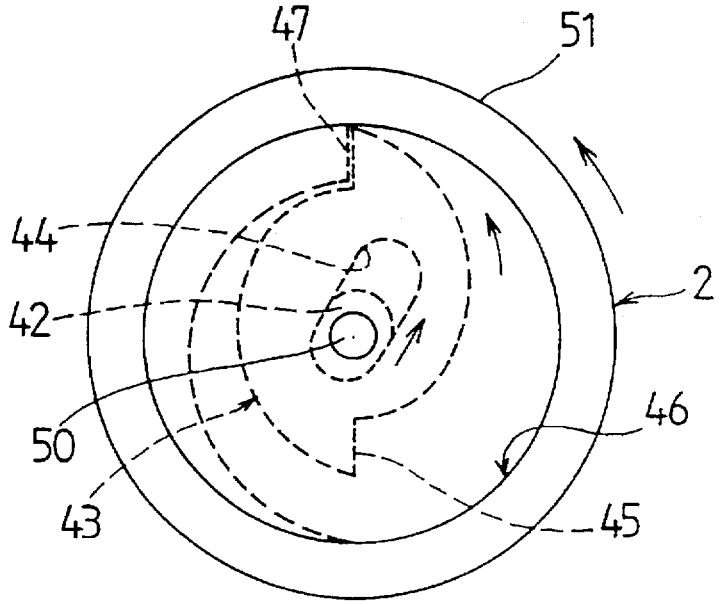
FIG. 5A is a front view of a structure of a left-front wheel, when the steering motor is driven, in a preferred embodiment according to the present invention.
Figure 5B:
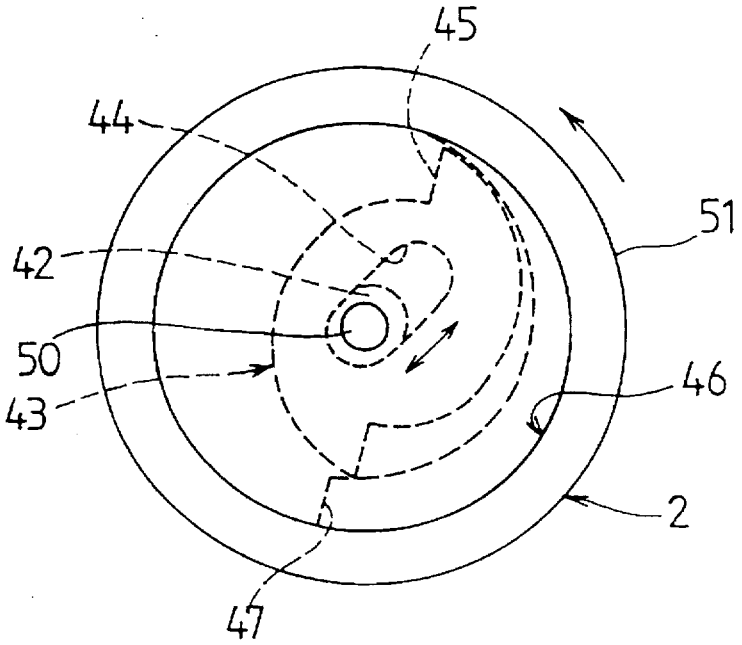
FIG. 5B is a front view of a structure of a left-front wheel, when the steering motor is in a standstill, in a preferred embodiment according to the present invention.

FIG. 5A is illustrative of a structure of the left-front wheel 2 when the steering motor 7 is driven and FIG. 5B is illustrative of the structure of the left-front wheel 2 when the steering motor 7 is in standstill. When the steering motor 7 is driven, the left-front wheel 2 rotates along with the rotary shaft 8. When the steering motor 7 is in standstill, then the left-front wheel 2 rotates by inertia freely from the rotary shaft 8.

With reference to FIG. 5A, when the steering motor 7 is driven and the rotary shaft 8 rotates, then the elliptically, cylindrically shaped holding member 42 fixed to the end of the rotary shaft 8 rotates along with the rotary shaft 8. Since the elliptically, cylindrically shaped holding member 42 partially fits into the elliptically shaped opening 44 of the elliptically shaped cam 43, the rotation of the elliptically, cylindrically shaped holding member 42 causes a rotation of the elliptically shaped cam 43. The direction of the rotation of the left-front wheel is the counterclockwise direction. The gap between the elliptically shaped opening 44 of the elliptically shaped cam 43 and the elliptically, cylindrically shaped holding member 42 allows the elliptically shaped cam 43 to move in relation to the elliptically, cylindrically shaped holding member 42 in a direction parallel to the longitudinal direction of the elliptically shaped opening 44 by a distance corresponding to the difference in length of major axis between the elliptically, cylindrically shaped holding member 42 and the elliptically shaped cam 43. Thus, the rotation of the elliptically shaped cam 43 generates a centrifugal force applied thereto whereby the elliptically shaped cam 43 moves in the direction parallel to the longitudinal direction of the elliptically shaped opening 44 by the distance corresponding to the difference in length of major axis between the elliptically, cylindrically shaped holding member 42 and the elliptically shaped cam 43. As a result, the elliptically, cylindrically shaped holding member 42 comes in contact with the end of the elliptically shaped opening 44 so that the elliptically shaped cam 43 becomes positioned offset from the center of the cylindrically shaped annular wheel member 46. As a result, the stepped face of the ridged portion 47 just fits to one of the stepped portions 45 of the elliptically shaped cam 43 as well illustrated in FIG. 5A. The stepped portions 45 of the elliptically shaped cam 43 pushes, in the counterclockwise direction, the stepped face of the ridged portion 47 fixed to the radially inner surface of the cylindrically shaped, annular wheel member 46 whereby the cylindrically shaped annular wheel member 46 rotates in the counterclockwise direction. Since only the left-front wheel 2 is driven by the steering motor 7 while the right front wheel 3 rotates freely from the rotation by the steering motor 7, the rotatable steering plate 6 is forced to rotate in a direction marked by a real arrow mark until the rotatable steering plate 6 is directed to the longitudinal direction of the chassis 1. As a result, the radio-controlled toy car goes straight.

If the motor driving push button 21 of the control signal transmitter is pushed off, the transmission of the motor driving control signal is discontinued whereby the steering motor 7 is in standstill and the rotation of the rotary shaft 8 is discontinued. The rotation of the elliptically, cylindrically shaped holding member 42 is also discontinued, whereby the rotation of the elliptically shaped cam 43 is further discontinued. As a result, the centrifugal force having been applied to the elliptically shaped cam 43 disappears, whereby the elliptically shaped cam 43 moves in the direction parallel to the longitudinal direction of the elliptically shaped opening 44 by the distance corresponding to the difference in length of major axis between the elliptically, cylindrically shaped holding member 42 and the elliptically shaped cam 43. The cylindrically shaped annular wheel member 46 may rotate in the counterclockwise direction by inertia separately from the elliptically shaped cam 43 which has been in standstill, whereby the stepped face of the ridged portion 47 fixed to the radially inner surface of the cylindrically shaped annular wheel member 46 is detached from the stepped portion 45 of the elliptically shaped cam 43. Since the tapered portion of the ridged portion 47 is directed to the counterclockwise direction in which the cylindrically shaped annular wheel member 46 rotates, the cylindrically shaped annular wheel member 46 may rotate freely from the elliptically shaped cam 43 having already been in standstill. The rotatable steering plate 6 is forced by the extension force of the spring member 13 to rotate toward the left side by the predetermined maximum angle from the longitudinal direction of the chassis 1. As a result, the radio-controlled toy car turns left.

As modifications of the present invention, it is possible for the spring member to provide a diminishing force for pulling the right rear end of the rotatable steering plate 6 so that the rotatable steering plate 6 is forced to tilt the right side by the predetermined maximum angle from the longitudinal center axis of the chassis 1. It is also possible to provide a steering system connected to the rear wheels 4 and 5.

Whereas any further modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A steering system provided on a chassis of a toy car comprising:

a rotatable steering plate on the chassis, said steering plate being rotatable in a horizontal plane by a maximum angle toward left and right directions from a longitudinal center axis of the chassis;

means for urging said rotatable steering plate to rotate toward one of said left and right directions from said longitudinal center axis of the chassis, said urging means being affixed to said chassis and mechanically connected to said rotatable steering plate at a distance from said longitudinal center axis of the chassis;

a steering motor on said steering plate for generating a rotational power, said steering motor having a motor shaft;

a rotary shaft on said steering plate;

a transmission system mechanically connecting said motor shaft and said rotary shaft for transmitting said rotational power generated by said steering motor to said rotary shaft;

a first wheel mechanically connected to a first end of said rotary shaft, said first wheel being freely rotatable about said rotary shaft; and a second wheel mechanically connected to a second end of said rotary shaft, said second wheel having a clutch mechanism so operating that if said steering motor is driven, then said rotational power is transmitted to said second wheel and thus said second wheel is driven whereby said rotatable steering plate is forced to align with said longitudinal center axis of said chassis, and if said steering motor is not driven, then said rotational power is not generated by said steering motor and thus said second wheel is not driven, whereby said rotatable steering plate is urged to rotate toward said one of said left and right directions from said longitudinal center axis of the chassis.

2. The steering system as claimed in claim 1, wherein said urging means comprises a spring member providing an extension force to push a rear side portion of said rotatable steering plate in a front direction.

3. The steering system as claimed in claim 1, wherein said urging means comprises a spring member providing a contraction force to pull a rear side portion of said rotatable steering plate in a rear direction.

4. The steering system as claimed in claim 1, wherein said transmission system comprises a plurality of gears.

5. The steering system as claimed in claim 1, wherein said clutch mechanism of said second wheel comprises:

a disk-like plate mechanically connected to said rotary shaft so that said disk-like plate rotates freely from rotation of the rotary shaft, said disk-like plate having an outside surface on which an annular ridge is coaxially fixed, a center portion of said disk-like plate having a disk-like plate opening through which said rotary shaft passes so that the disk-like plate can rotate freely about said rotary shaft;

a holding member mechanically fixed to said second end of said rotary shaft and positioned on an outside face of said disk-like plate so that said holding member retains said disk-like plate on said rotary shaft, but allows said disk-like plate to rotate freely about said rotary shaft, said holding member having an elliptic cylinder shape and extending outwardly;

a cylindrically shaped convex portion on said holding member, said cylindrically shaped convex portion being coaxially positioned on said holding member so that the convex portion extends from said holding member outwardly, said convex portion having a smaller diameter than a major axis and a minor axis of said holding member;

an elliptically, cylindrically shaped cam having two stepped portions at opposite ends on a major axis of said cam, said stepped portions facing a direction opposite to a rotational direction of said second wheel, said cam having a central elliptically shaded cam opening, said cam opening having a major axis tilted by less than 45° from said major axis of said cam in said direction opposite to said rotational direction of said second wheel, said major axis of said cam opening being sufficiently longer than said major axis of said holding member and a minor axis of said cam opening being just larger than said minor axis of said holding member so that said cam opening receives said holding member, forming a gap between said cam opening and said holding member;

a wheel having an open inside portion and an outside portion closed by a disk with a central hole, said hole receiving said convex portion; and a ridged portion extending along a radially inner surface of said wheel and toward a radially inside direction, said ridged portion having a stepped face for fitting any of said stepped portions, a height of said ridged portion being gradually reduced to zero in said rotational direction of said second wheel.

6. A radio-controlled toy car comprising:

a chassis;

a body on said chassis;

a driving motor for driving a driving shaft which connects a pair of driving wheels for propelling said radio-controlled toy car;

a rotatable steering plate on the chassis, said steering plate being rotatable in a horizontal plane by a maximum angle toward left and right directions from a longitudinal center axis of the chassis;

means for urging said rotatable steering plate to rotate toward one of said left and right directions from said longitudinal center axis of the chassis, said urging means being affixed to said chassis and mechanically connected to said rotatable steering plate at a distance from said longitudinal center axis of the chassis; p1 a steering motor on said steering plate for generating a rotational power, said steering motor having a motor shaft;

a control unit on said chassis for controlling operations of said steering motor;

a rotary shaft on said steering plate;

a transmission system mechanically connecting said motor shaft and said rotary shaft for transmitting said rotational power generated by said steering motor to said rotary shaft;

a first wheel mechanically connected to a first end of said rotary shaft, said first wheel being freely rotatable about said rotary shaft; and a second wheel mechanically connected to a second end of said rotary shaft, said second wheel having a clutch mechanism so operating that if said steering motor is driven, then said rotational power is transmitted to said second wheel and thus said second wheel is driven whereby said rotatable steering plate is forced to align with said longitudinal center axis of said chassis, and if said steering motor is not driven, then said rotational power is not generated by said steering motor and thus said second wheel is not driven, whereby said rotatable steering plate is urged to rotate toward said one of said left and right directions from said longitudinal center axis of the chassis.

7. The radio controlled toy car as claimed in claim 6, wherein said urging means comprises a spring member providing an extension force to push a rear side portion of said rotatable steering plate in a front direction.

8. The radio-controlled toy car as claimed in claim 6, wherein said forcing means comprises a spring member providing a contraction force to pull a rear side portion of said rotatable steering plate in a rear direction.

9. The radio-controlled toy car as claimed in claim 6, wherein said transmission system comprises a plurality of gears.

10. The radio-controlled toy car as claimed in claim 6, wherein said clutch mechanism of said second wheel comprises:

a disk-like plate mechanically connected to said rotary shaft so that said disk-like plate rotates freely from rotation of the rotary shaft, said disk-like plate having an outside surface on which an annular ridge is coaxially fixed, a center portion of said disk-like plate having a disk-like plate opening through which said rotary shaft passes so that the disk-like plate can rotate freely about said rotary shaft;

a holding member mechanically fixed to said second end of said rotary shaft and positioned on an outside face of said disk-like plate so that said holding member retains said disk-like plate on said rotary shaft, but allows said disk-like plate to rotate freely about said rotary shaft, said holding member having an elliptic cylinder shape and extending outwardly;

a cylindrically shaped convex portion on said holding member, said cylindrically shaped convex portion being coaxially positioned on said holding member so that the convex portion extends from said holding member outwardly, said convex portion having a smaller diameter than a major axis and a minor axis of said holding member;

an elliptically, cylindrically shaped cam having two stepped portions at opposite ends on a major axis of said cam, said stepped portions facing a direction opposite to a rotational direction of said second wheel, said cam having a central elliptically shaped cam opening, said cam opening having a major axis tilted by less than 45° from said major axis of said cam in said direction opposite to said rotational direction of said second wheel, said major axis of said cam opening being sufficiently longer than said major axis of said holding member and a minor axis of said cam opening being just larger than said minor axis of said holding member so that said cam opening receives said holding member forming a gap between said cam opening and said holding member;

a wheel having an open inside portion and an outside portion closed by a disk with a central hole said hole receiving said convex portion; and a ridged portion extending along a radially inner surface of said wheel and toward a radially inside direction, said ridged portion having a stepped face for fitting any of said stepped portions, a height of said ridged portion being gradually reduced to zero in said rotational direction of said second wheel.

* * * * *